US011149632B1

(12) United States Patent
Wade et al.

(10) Patent No.: US 11,149,632 B1
(45) Date of Patent: Oct. 19, 2021

(54) ENGINE SYSTEM WITH VARIABLE COMPRESSION RATIO MECHANISM AND METHOD FOR OPERATION OF SAID SYSTEM

(71) Applicant: Ford Global Technologies, LLC, Dearborn, MI (US)

(72) Inventors: Robert Wade, Plymouth, MI (US); James R. Clarke, Levering, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/992,977

(22) Filed: Aug. 13, 2020

(51) Int. Cl.
*F02B 75/04* (2006.01)
*F02D 15/02* (2006.01)

(52) U.S. Cl.
CPC ..... *F02B 75/045* (2013.01); *F02D 15/02* (2013.01); *F02D 2200/101* (2013.01)

(58) Field of Classification Search
CPC ... F02D 15/02; F02D 2200/101; F02B 75/045
See application file for complete search history.

(56) References Cited

U.S. PATENT DOCUMENTS 4,370,901 A 2/1983 Bolen
4,809,650 A * 3/1989 Arai ..... F02B 75/044 123/48 B
5,245,962 A 9/1993 Routery
6,497,203 B1 12/2002 Rao et al.
6,622,669 B1 * 9/2003 Nageswar Rao ..... F02B 75/045 123/48 B
7,533,638 B1 5/2009 Berger
7,546,820 B2 6/2009 Berger
9,784,305 B2 10/2017 Wittek

FOREIGN PATENT DOCUMENTS

DE 102017119320 A1 10/2017
JP 5907552 B2 4/2016

* cited by examiner

*Primary Examiner* — Kevin A Lathers
(74) *Attorney, Agent, or Firm* — Geoffrey Brumbaugh; McCoy Russell LLP

(57) ABSTRACT

Methods and systems for damping an impact velocity in an engine system are provided. In one example, the engine system comprises a variable compression ratio (VCR) mechanism including a rod length adjustment assembly configured to adjust a distance between a crankshaft interface and a piston interface. The rod length adjustment assembly also includes a fluid control circuit including a damping cavity positioned between a first rod section and second rod section and configured to dampen a relative motion between the first and second rod sections during a compression ratio adjustment to reduce noise, vibration, and/or harshness (NVH).

20 Claims, 6 Drawing Sheets

ENGINE SYSTEM WITH VARIABLE COMPRESSION RATIO MECHANISM AND METHOD FOR OPERATION OF SAID SYSTEM

FIELD

The present description relates generally to methods and systems for adjusting the compression ratio of an engine.

BACKGROUND/SUMMARY

Certain engines are designed with variable compression ratio (VCR) functionality to increase engine adaptability. VCR engines allow fuel economy and performance tradeoffs to be tuned to achieve desired values. For instance, higher compression ratio engines may exhibit increased fuel economy with a lower knock limit, which decreases the engine's power output. Conversely, lower compression ratio engines are not as knock limited, allowing the engine to provide higher power outputs with the tradeoff of decreased engine fuel economy, if desired.

Multi-link type VCR systems and variable length connecting rod mechanisms have been utilized in previous engines to achieve VCR functionality. Multi-link VCR systems provide continuously variable compression ratio adjustment while variable length connecting rod mechanisms provide a discrete number of compression ratio modes. One example approach for varying engine compression ratio is shown by Rao in U.S. Pat. No. 6,497,203 B2. Rao discloses an engine with a variable length connecting rod mechanism with two discrete compression ratio settings (a high compression ratio setting and a low compression ratio setting).

The inventors have recognized several drawbacks with Rao's VCR system. For instance, during the transition between the higher and lower compression ratio modes, the variable length connecting rod mechanism may experience impacts between a sliding ring and a housing in the mechanism. The impact increases noise, vibration, and harshness (NVH) in the engine. Furthermore, the impact may degrade the VCR system over time.

The inventors have recognized the drawbacks with Rao's system and other VCR systems and developed an engine system to at least partially overcome the drawbacks. In one example, the engine system includes a mechanism having a rod length adjustment assembly configured to adjust a distance between a crankshaft interface and a piston interface. The rod length adjustment assembly also includes a fluid control circuit having a damping cavity positioned between a first rod section and second rod section and configured to dampen a relative motion between the first and second rod sections during a compression ratio adjustment to reduce NVH. In this way, a damping circuit can be provided in VCR mechanism to decrease impact velocity between components therein. Consequently, engine NVH may be decreased, resulting in increased customer satisfaction and engine longevity.

In one example, the fluid control circuit includes a drain passage in fluidic communication with the damping cavity and configured to restrict fluid flow out of the damping cavity. Using a drain passage to restrict fluid flow out of the damping cavity allows the impact damping provided by the fluid control circuit to be precisely tuned to achieve desired impact damping characteristics in the VCR mechanism.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-5 are drawn approximately to scale. However, other relative component dimensions may be used, in other embodiments.

DETAILED DESCRIPTION

The following description relates to systems and methods for damping a variable compression ratio (VCR) mechanism in an engine. The damping decreases the impact velocity between the switching components in the mechanism, thereby decreasing engine noise, vibration, and harshness (NVH). To accomplish the impact damping, in one example, the VCR system includes a damping circuit with a damping cavity having pressurized fluid (e.g., oil or other suitable lubricant) routed thereto. The damping cavity is positioned between components in a first rod section and a second rod section exhibiting motion relative to one another during a compression ratio modal transition. The fluid is routed to the damping cavity via a supply passage and flows out of the cavity via a drain passage. The size of the drain passage may be selected to strike a desired balance between impact damping and the duration of compression ratio switching in the mechanism.

Figure 1:
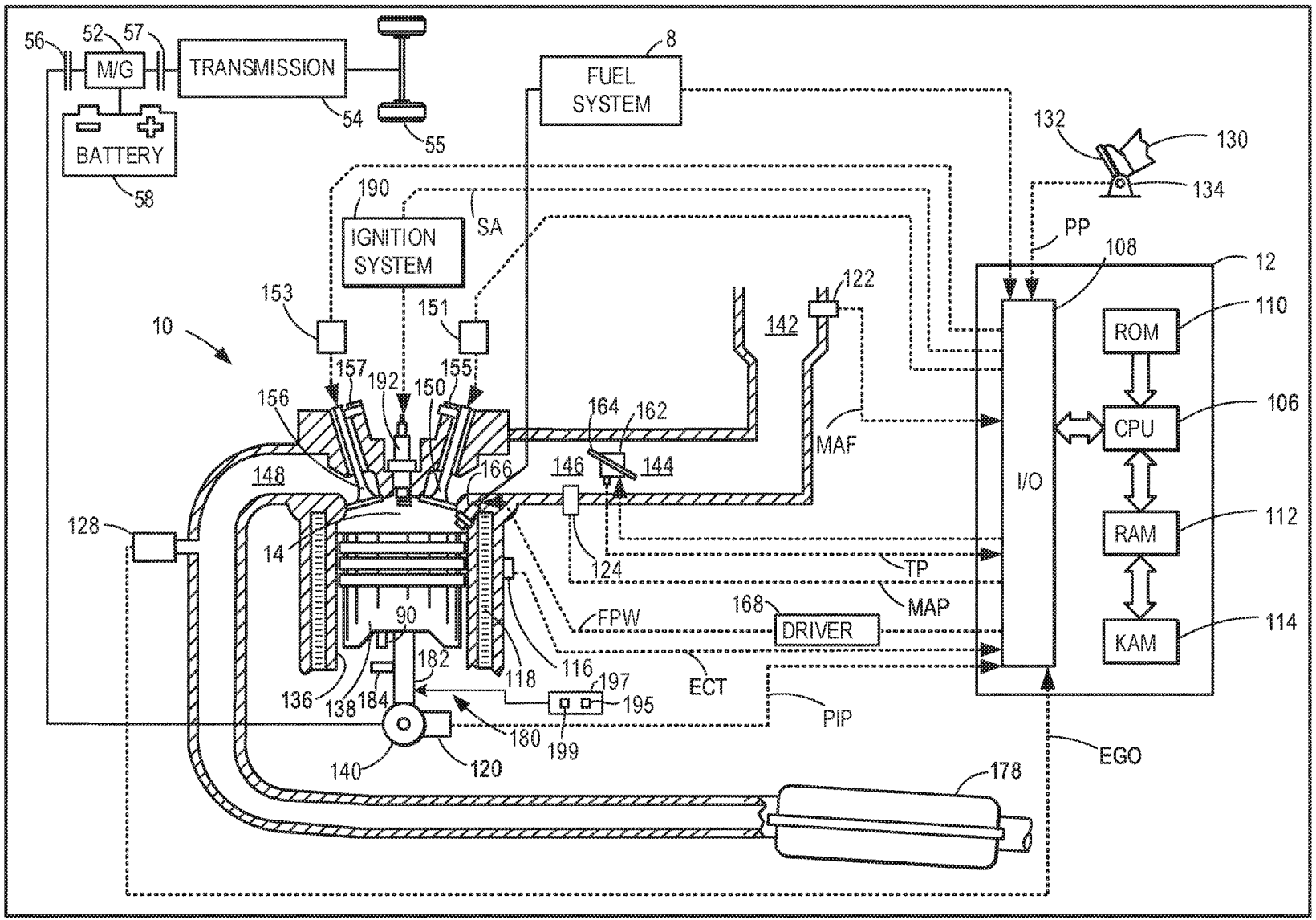
FIG. 1 is a schematic depiction of a vehicle with an engine including a variable compression ratio (VCR) mechanism.
Figure 2:
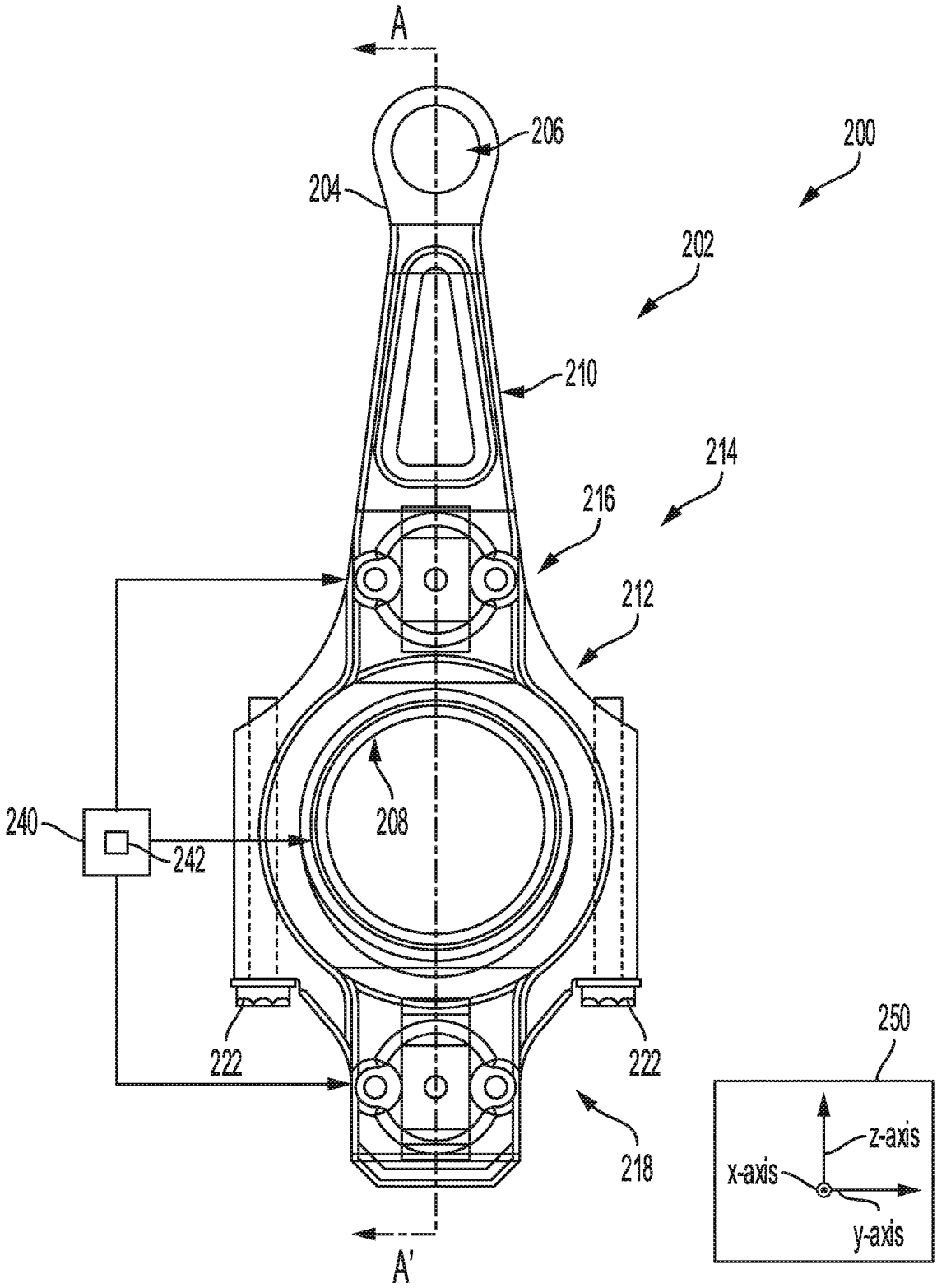
FIG. 2 shows a side view of an engine system including a VCR mechanism.
Figure 3:
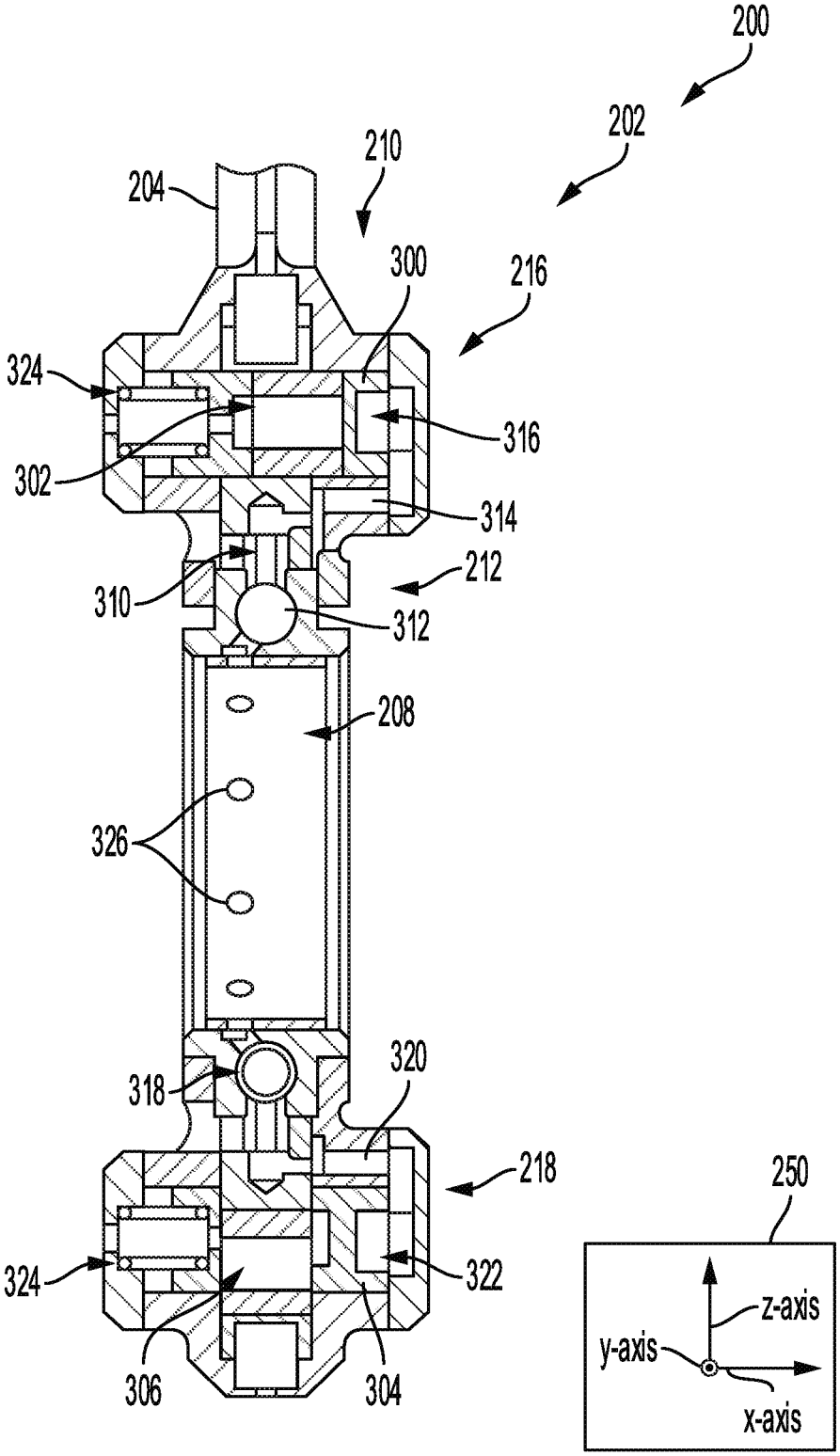
FIG. 3 shows a cross-sectional view of the VCR mechanism, depicted in FIG. 2, operating in a first mode.
Figure 4:
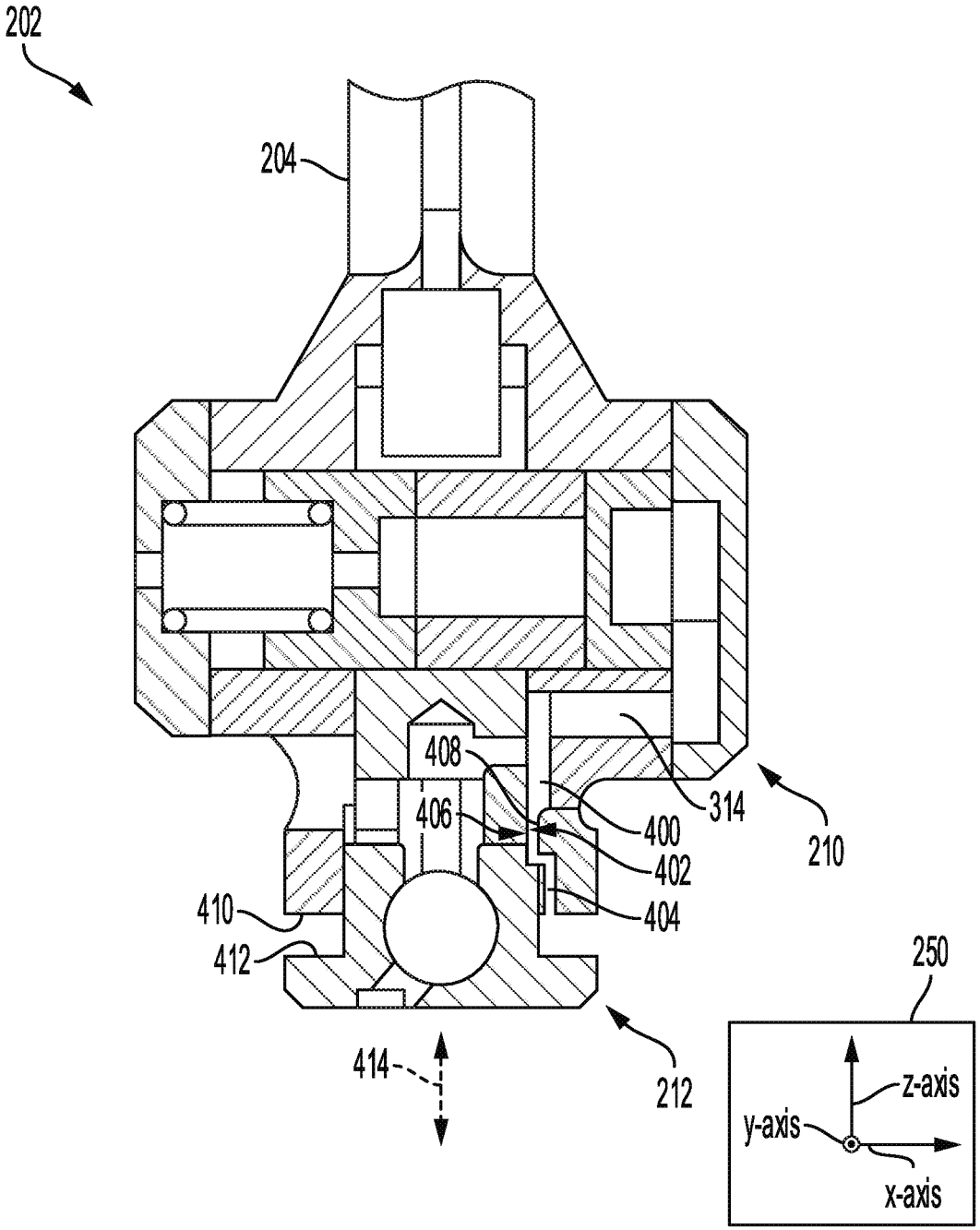
FIG. 4 shows a detailed view of a section of the VCR mechanism depicted in FIG. 3.
Figure 5:
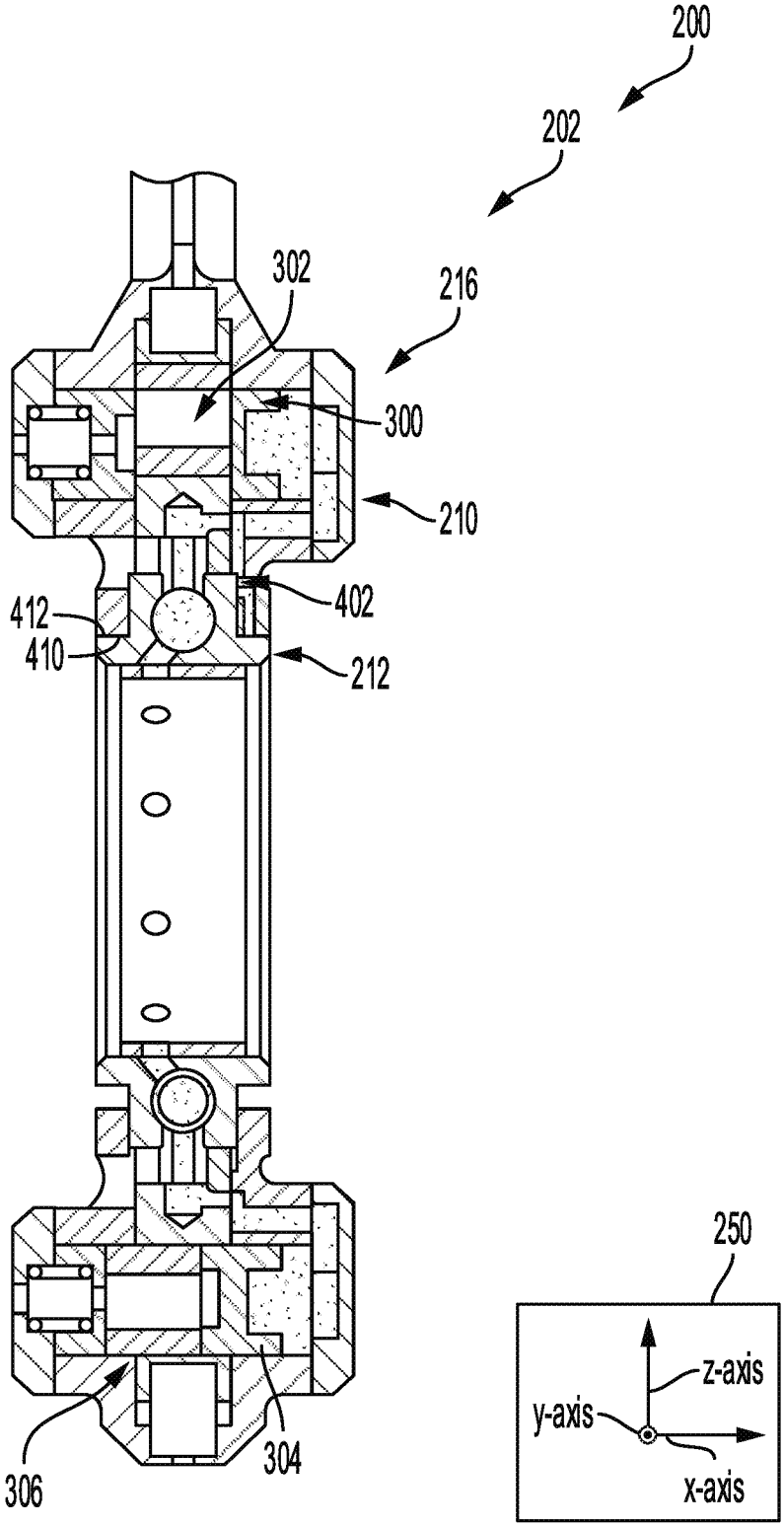
FIG. 5 shows a cross-sectional view of the VCR mechanism, depicted in FIG. 2, operating in a second mode.
Figure 6:
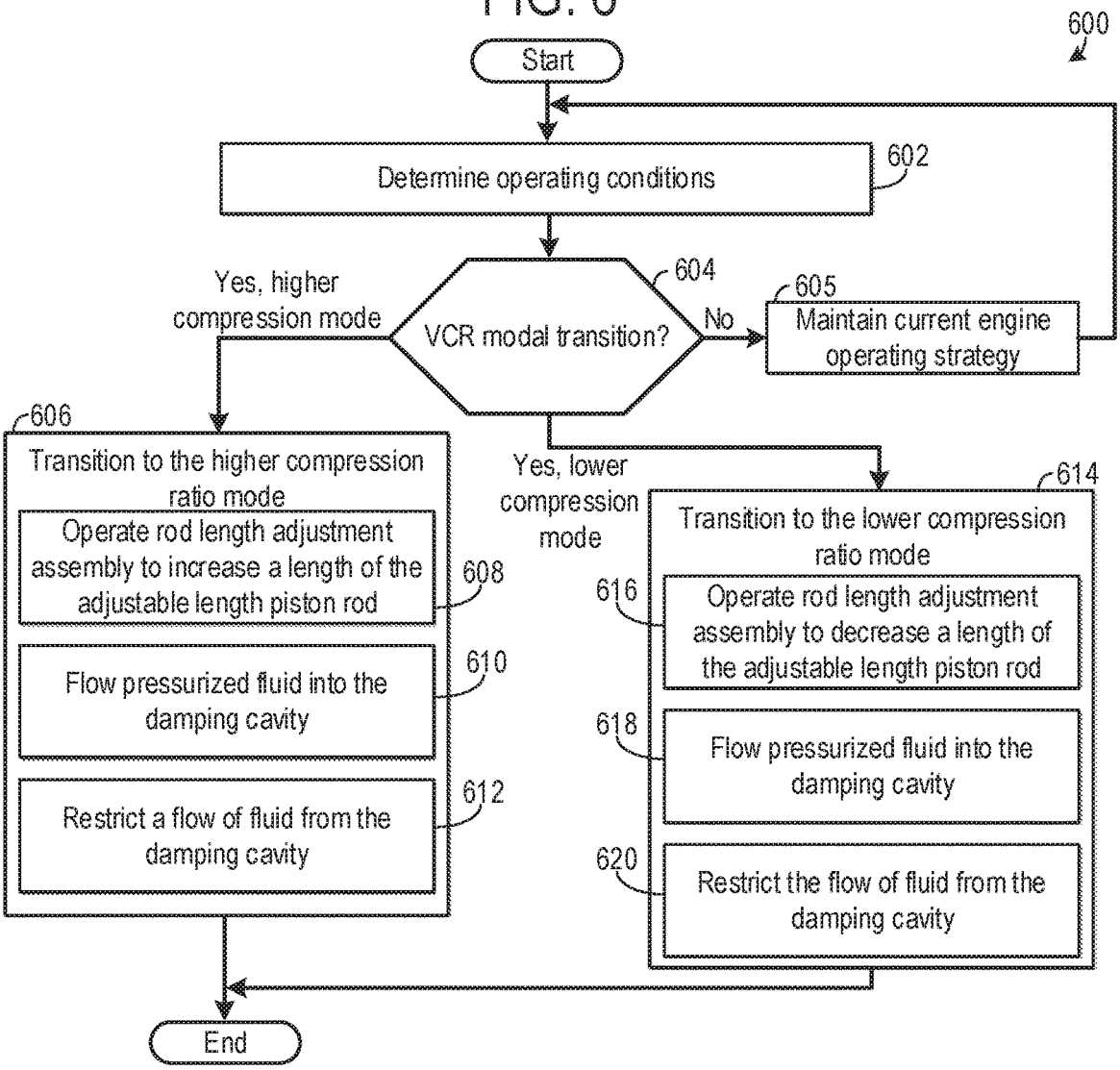
FIG. 6 shows a method for operation of an engine system with a VCR mechanism.
Figure 7:
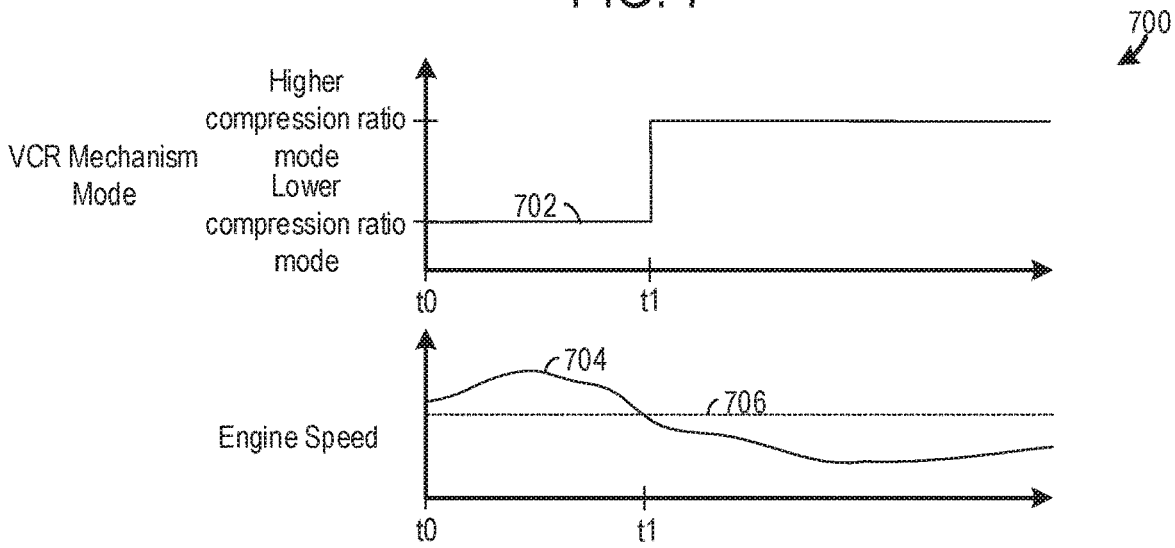
FIG. 7 shows a graphical representation of a use-case control strategy for an engine system with a VCR mechanism.

FIG. 1 is a high level illustration of a vehicle with an engine having a VCR engine system. FIG. 2 shows a side view of an example of a VCR engine system. FIGS. 3 and 4 show cross-sectional views of the VCR engine system, depicted in FIG. 2, in a first compression ratio mode. FIG. 5 shows a cross-sectional view of the VCR engine system, depicted in FIG. 2, in a second compression ratio mode. FIG. 6 shows a method for operation of a VCR engine system. FIG. 7 shows a graphical representation of a use-case control technique for a VCR engine system.

FIG. 1 shows a vehicle 5 with an engine 10. The engine 10 includes an engine system 180 (e.g., VCR system) in which a VCR mechanism 182 resides. Although the VCR mechanism 182 is schematically depicted, it will be understood that the assembly has greater structural and functional complexity which is expanded upon in greater detail herein with regard to FIGS. 2-5.

FIG. 1 depicts an example embodiment of a combustion chamber (herein, also referred to as "cylinder") 14 of the internal combustion engine 10. Engine 10 may receive control parameters from a control system, including a controller 12, and input from a vehicle operator 130 via an input device 132. In this example, input device 132 includes an accelerator pedal and a pedal position sensor 134 for generating a proportional pedal position signal PP. Cylinder 14 of engine 10 may include combustion chamber walls 136 with a piston 138 positioned therein. Piston 138 may be coupled to a crankshaft 140 so that reciprocating motion of the piston is translated into rotational motion of the crankshaft. The piston 138 is coupled to the crankshaft 140 via the VCR mechanism 182, described in further detail herein. Crankshaft 140 may be coupled to at least one vehicle wheel 55 of the passenger vehicle via a transmission system 54. Further, a starter motor may be coupled to crankshaft 140 via a flywheel to enable a starting operation of engine 10.

Engine 10 may be configured as a VCR engine wherein the compression ratio (CR) of each cylinder (a ratio of a cylinder volume when the piston is at bottom-dead-center (BDC) to a cylinder volume when the piston is at top-dead-center (TDC)) can be mechanically altered. The CR of the engine may be varied via the VCR mechanism 182, as previously mentioned. In some examples, the CR may be varied between a first, lower CR (where the ratio of the cylinder volume when the piston is at BDC to the cylinder volume when the piston is at TDC is smaller) and a second, higher CR (where the ratio is higher). In still other examples, there may be predefined number of stepped compression ratios between the first, lower CR and the second, higher CR. Further still, the CR may be continuously variable between the first, lower CR and the second, higher CR (to any CR in between).

In the depicted example, VCR mechanism 182 is coupled to piston 138 such that the VCR mechanism may change the piston TDC position. For example, piston 138 may be coupled to crankshaft 140 via VCR mechanism 182, which may be a piston position changing mechanism that moves the piston closer to or further from the cylinder head, thus changing the position of the piston and thereby the size of combustion chamber 14. A position sensor 184 may be coupled to the VCR mechanism 182 and may be configured to provide feedback to controller 12 regarding the position of VCR mechanism 182 (and thereby the CR of the cylinder). The VCR mechanism 182 is also coupled to the crankshaft 140.

In one example, changing the position of the piston within the combustion chamber also changes the relative displacement of the piston within the cylinder. The VCR mechanism designed to alter piston position may be coupled to a conventional cranktrain or an unconventional cranktrain. Non-limiting examples of an unconventional cranktrain to which the VCR mechanism may be coupled, include variable distance head crankshafts and variable kinematic length crankshafts. In one example, crankshaft 140 may be configured as an eccentric shaft. In another example, an eccentric may be coupled to, or in the area of, a piston pin, with the eccentric changing the position of the piston within the combustion chamber. Movement of the eccentric may be controlled by oil passages in the piston rod.

In one example, the VCR mechanism 182 may include a first component that varies the position of the piston and a second component that maintains the position of the piston by locking VCR mechanism 182 in place. The second component may be actuated based on hydraulic pressure provided by oil reservoirs in engine 10. As such, the VCR mechanism is shown coupled to a lubrication system 197. Cylinder 14 may receive intake air via a series of intake air passages 142, 144, and 146. Intake air passage 146 can communicate with other cylinders of engine 10 in addition to cylinder 14. In some embodiments, one or more of the intake passages may include a boosting device such as a compressor in a turbocharger or a supercharger. A throttle 162, including a throttle plate 164, may be provided between intake air passage 144 and intake air passage 146 for varying the flow rate and/or pressure of intake air provided to the engine cylinders.

Exhaust passage 148 may receive exhaust gases from other cylinders of engine 10 in addition to cylinder 14. An exhaust gas sensor 128 is shown coupled to exhaust passage 148 upstream of an emission control device 178. Exhaust gas sensor 128 may be any suitable sensor for providing an indication of exhaust gas air-fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example. Emission control device 178 may be a three-way catalyst (TWC), NOx trap, various other emission control devices, or combinations thereof.

Exhaust temperature may be estimated by one or more temperature sensors (not shown) located in exhaust passage 148. Alternatively, exhaust temperature may be inferred based on engine operating conditions such as engine speed, engine load, AFR, spark timing, etc. Further, exhaust temperature may be determined from one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including one intake poppet valve 150 and one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via a cam actuation system 151. Similarly, exhaust valve 156 may be controlled by controller 12 via a cam actuation system 153. Cam actuation systems 151 and 153 may each include one or more cams and may utilize one or more of cam profile switching (CPS), variable cam timing (VCT), variable valve timing (VVT), and/or variable valve lift (VVL) systems that may be operated by controller 12 to vary valve operation. The position of intake valve 150 and exhaust valve 156 may be determined by valve position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation, including CPS and/or VCT systems. In still other embodiments, the intake and exhaust valves may be controlled by a common valve actuator or actuation system or a variable valve timing actuator or actuation system.

Cylinder 14 may have an associated compression ratio, which, as described above, is the ratio of volumes when piston 138 is at BDC to TDC. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock. The compression ratio may be desired to be higher for a Miller or Atkinson style combustion cycle where greater fuel efficiency is desired. The compression ratio may also be varied based on driver demand via adjustments to the VCR mechanism 182, varying the effective position of piston 138 within combustion chamber 14. The compression ratio may be inferred based on feedback from sensor 184 regarding the position of the VCR mechanism 182.

In some embodiments, each cylinder of engine 10 may include a spark plug 192 for initiating combustion. An ignition system 190 may provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel, as may be the case with some diesel engines.

In some embodiments, each cylinder of engine 10 may be configured with one or more fuel injectors for providing fuel thereto. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection ("DI") of fuel into cylinder 14. While FIG. 1 shows injector 166 as a side injector, injector 166 may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8, which may include one or more fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the one or more fuel tanks may have a pressure transducer providing a signal to controller 12. It will be appreciated that, in an alternate embodiment, injector 166 may be a port injector providing fuel into the intake port upstream of cylinder 14.

It will also be appreciated that while the depicted embodiment illustrates the engine being operated by injecting fuel via a single direct injector, in alternate embodiments, the engine may be operated by using two or more injectors (for example, a direct injector and a port injector per cylinder, or two direct injectors/two port injectors per cylinder, etc.) and varying a relative amount of injection into the cylinder from each injector.

Fuel may be delivered by the injector to the cylinder during a single cycle of the cylinder. Further, the distribution and/or relative amount of fuel delivered from the injector may vary with operating conditions. Furthermore, for a single combustion event, multiple injections fuel may be performed per cycle. The multiple injections may be performed during the compression stroke, intake stroke, or any appropriate combination thereof in what is known as split injection. Also, fuel may be injected during the cycle to adjust the air-fuel ratio (AFR) of the combustion. For example, fuel may be injected to provide a stoichiometric AFR. An AFR sensor may be included to provide an estimate of the in-cylinder AFR. In one example, the AFR sensor may be an exhaust gas sensor, such as EGO sensor 128. By measuring an amount of oxygen in the exhaust gas, which is higher for lean mixtures and lower for rich mixtures, the sensor may determine the AFR. As such, the AFR may be provided as a lambda (λ) value, which is a ratio of the determined AFR to a stoichiometric AFR (e.g., the AFR for a complete combustion reaction to occur) for a given mixture. Thus, a λ value of 1.0 indicates a stoichiometric mixture, while a λ value less than 1.0 indicates richer than stoichiometry mixtures and a λ value greater than 1.0 indicates leaner than stoichiometry mixtures.

As described above, FIG. 1 shows only one cylinder of a multi-cylinder engine. As such each cylinder may similarly include its own set of intake/exhaust valves, fuel injector(s), spark plug(s), etc.

Fuel tanks in fuel system 8 may hold fuel with different fuel qualities, such as different fuel compositions. These differences may include different alcohol content, different octane, different heats of vaporization, different fuel blends, and/or combinations thereof, etc.

Controller 12 is shown in FIG. 1 as a microcomputer, including a microprocessor unit 106, input/output ports 108, an electronic storage medium for executable programs and calibration values shown as read-only memory chip 110 in this particular example, a random access memory 112, a keep alive memory 114, and a data bus. Controller 12 may receive various signals from sensors coupled to engine 10, including, in addition to those signals previously discussed, a measurement of inducted mass air flow (MAF) from a mass air flow sensor 122, a knock sensor 90 coupled to each cylinder 14 for identifying abnormal cylinder combustion events, engine coolant temperature (ECT) from a temperature sensor 116 coupled to a cooling sleeve 118, a profile ignition pickup signal (PIP) from a Hall effect sensor 120 (or other type) coupled to crankshaft 140, throttle position (TP) from a throttle position sensor, an absolute manifold pressure signal (MAP) from a MAP sensor 124, cylinder AFR from EGO sensor 128, abnormal combustion from knock sensor 90 and a crankshaft acceleration sensor, and VCR mechanism position from position sensor 196. Engine speed signal, RPM, may be generated by controller 12 from signal PIP. The signal MAP from MAP sensor 124 may be used to provide an indication of vacuum or pressure in the intake manifold. Controller 12 receives signals from the various sensors of FIG. 1 and employs the various actuators of FIG. 1 to adjust engine operation based on the received signals and instructions stored on a memory of the controller. For example, based on the engine speed and load, the controller may adjust the compression ratio of the engine by sending a signal to the VCR mechanism 182 to mechanically move the piston closer to or further from the cylinder head, thereby changing a volume of the combustion chamber.

Non-transitory storage medium read-only memory 110 can be programmed with computer readable data representing instructions executable by microprocessor unit 106 for performing the methods described below as well as other variants that are anticipated but not specifically listed.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56, 57 are engaged. In the depicted example, a first clutch 56 is provided between crankshaft 140 and electric machine 52, and a second clutch 57 is provided between electric machine 52 and transmission 54. Controller 12 may send a signal to an actuator of each clutch to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another suitable type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation.

Variation of an engine compression ratio may be achieved by coupling a crankshaft of an engine to a VCR mechanism. The VCR mechanism may include locking devices configured to adjust and maintain a displacement of a piston within a combustion chamber, thereby varying the compression ratio. The locking devices may be hydraulically controlled. The hydraulic system for the locking devices may, in some instances, not rely on gears or a motor contributing to NVH issues and adding complexity and weight to the engine. Furthermore, the actuation of the VCR mechanism does not adversely affect energy consumption of the engine, thereby increasing a fuel economy of the engine by varying the compression ration according to engine operating conditions.

The lubrication system 197 is designed to provide lubricant (e.g., oil) to engine components such as the pistons, crankshaft, camshafts, etc. To accomplish the lubricant delivery functionality the system may include lines, valves, pumps (e.g., oil pump 199), a reservoir 195, etc. The lubrication system 197 may also route lubricant to selected components for component adjustment. For instance, the VCR mechanism 182 in the engine system 180 may receive pressurized lubricant. In such an example, valving can be provided to regulate the amount of lubricant routed to the VCR mechanism to induce compression ratio switching. For instance, oil with a pressure less than a switching threshold may delivered to the VCR mechanism to maintain the VCR mechanism in a lower compression ratio configuration. Conversely, oil pressurized greater than a threshold value may be routed to the VCR mechanism to reconfigure the mechanism into a higher compression ratio configuration. In some instances, the higher oil pressure may be maintained at the VCR mechanism to keep the mechanism in the higher compression ratio mode. However, in other instances, the VCR mechanism may be maintained in the higher compression ratio configuration even though the higher oil pressure is not maintained following the modal switch.

FIG. 2 depicts an example of an engine system 200. It will be understood that the engine system 200 shown in FIG. 2 is an example of the engine system 180, depicted in FIG. 1. As such, the engine system 200 may include structural and/or functional features from the engine system 180 or vice versa, in other embodiments.

The engine system 200 includes a VCR mechanism 202 configured to alter the engine's compression ratio. The VCR mechanism 202 includes a variable length connection rod 204 including a piston interface 206 a crankshaft interface 208. Typically, the piston interface 206 is attached to a piston via a pin and the crankshaft interface 208 is attached to a bearing sleeve of a crankshaft bearing. However, other suitable connection techniques may be utilized, in other examples.

The piston interface 206 is included in a first rod section 210 and the crankshaft interface 208 is included in a second rod section 212. The VCR mechanism 202 further includes a rod length adjustment assembly 214 designed to alter the distance between the piston interface 206 and the crankshaft interface 208 in the rod 204 to adjust the engine's compression ratio. In the illustrated example, the rod length adjustment assembly 214 includes a first locking device 216 and a second locking device 218 establishing the relative positon of the two rod sections in the different compression modes. Differently configured rod length adjustment assemblies have also been contemplated, such as assemblies with a single locking device, hydraulic pistons, etc. In other examples, the VCR mechanisms may include multiple links whose position may be hydraulically controlled.

The variable length connection rod 204 is also illustrated with fasteners 222 connecting split sections of the crankshaft interface 208. However, alternate rod configurations have been envisioned, such as a rod that does not include a split bearing retainer.

A lubrication system 240 routing a lubricant (e.g., oil) to the first locking device 216 and the second locking device 218 as well as the crankshaft interface 208 is also shown in FIG. 2. Although, the lubricant routing is depicted at a high-level, it will be understood that lubricant conduits such as conduits extending through the crankshaft may be used to route lubricant to the first locking device 216, the second locking device 218, the crankshaft interface 208, and/or possibly the piston interface 206, in some cases. The lubrication system 240 includes a valve 242 designed to adjust the flowrate of lubricant delivered to the first locking device 216 and the second locking device 218. The valve 242 may be configured to independently adjust the pressure of the fluid delivered to the different locking devices, in some examples, or cooperatively flow a similarly pressurized fluid to the locking devices, in other examples. The valve 242 may receive control signals from the controller 12, illustrated in FIG. 1.

Viewing plane A-A' indicating the cross-sectional view of FIGS. 3-5 is provided in FIG. 2. An axis system 250 is provided in FIG. 2 as well as FIGS. 3-5. The axis system 250 includes an x-axis, a y-axis, and a z-axis. The x-axis may be a lateral axis, the y-axis may be a longitudinal axis, and/or the z-axis may be a vertical axis. However, other orientations of the axes have been envisioned.

FIGS. 3 and 5 illustrate cross-sections of the VCR mechanism 202 in two discrete compression ratio configurations (a lower compression ratio configuration and a higher compression ratio configuration, respectively).

Turning specifically to FIG. 3, the engine system 200 with the VCR mechanism 202 are again shown along with the variable length connection rod 204 having the piston interface 206, shown in FIG. 2, in the first rod section 210 and the crankshaft interface 208 in the second rod section 212, the first locking device 216, and the second locking device 218.

The first locking device 216 may include a first lock pin 300 and a first lock pin recess 302. The second locking device 218 may correspondingly include a second lock pin 304 and a second lock pin recess 306. The first and second lock pins are configured to axially shift to allow for disengagement/engagement of the pins from the corresponding pin recess.

A fluid control circuit 310 receiving lubricant from the lubrication system 240, shown in FIG. 2, allows for hydraulic lock pin actuation. The hydraulic connection between the fluid control circuit 310 and the lubrication system 240, shown in FIG. 2, may be accomplished via a lubricant passage routed through the crankshaft, in one example. However, numerous suitable lubricant routing layouts have been envisioned.

A first control passage 312 and lock pin passage 314 route lubricant to a side 316 of the first lock pin 300. Increasing the pressure on the side 316 of the first lock pin 300 above a threshold value shifts the pin's axial position when the pin is aligned with the pin recess. In this way, the first locking device 216 may be hydraulically operated. A second control passage 318 and second lock pin fluid passage 320 route lubricant to a side 322 of the second lock pin 304. Thus, the second lock pin 304 may be hydraulically actuated in a similar manner to the first lock pin 300.

The VCR mechanism 202 may additionally include springs 324. The springs 324 function to exert a return force on the lock pins 300, 304. Consequently, when the hydraulic pressure on the lock pins is released, the springs cause the pins to decouple from their corresponding recess. In this way, the VCR mechanism 202 may efficiently toggle between pin-recess engagement/disengagement.

As shown in FIG. 3, when the first lock pin 300 is engaged with the first lock pin recess 302, the first rod section 210 and second rod section 212 exhibit a higher compression ratio configuration.

Conversely, as shown in FIG. 5, when the first lock pin 300 is disengaged from the lock pin recess 302, the first rod section 210 and the second rod section 212 are in a lower compression ratio configuration. In the higher compression ratio configuration the distance between the piston interface 205, shown in FIG. 2, and the crankshaft interface 208 is greater than the lower compression ratio configuration. Returning to FIG. 3, the second lock pin 304 is disengaged from the second lock pin recess 306 in the higher compression ratio configuration. However, the locking devices may exhibit other locking arrangements in the higher compression ratio configuration, in other embodiments.

Bearing holes 326 are also provided in the variable length connecting rod 204 and receive lubricant from a corresponding crankshaft bearing. It will be appreciated that the first control passage 312 may receive lubricant from the bearing holes 326. To elaborate, the bearing holes may provide a substantially continual flow of lubricant to passage 312 when, for example, one or more of the holes is blocked by the rotation of the crankshaft.

FIG. 4 shows a detailed view of the fluid control circuit 310 including a supply passage 400 branching off the first lock pin passage 314. The supply passage 400 axially extends downwards (towards the crankshaft interface) and leads to a damping cavity 402. Thus, the damping cavity 402 includes pressurized fluid (e.g., oil or other suitable lubricant) therein. As described herein, a pressurized fluid is a fluid having a pressure that has been increased (e.g., greater than atmospheric). In other examples, the supply passage may at least partially extend in an upward direction. A drain passage 404 opening into the damping cavity 402 is also provided in the fluid control circuit 310. The drain passage 404 is shown extending downward and opens above the crankshaft interface 208, depicted in FIG. 3. However, in other examples, the drain passage 404 may at least partially extend in an outward direction, away from a centerline 414 of the variable length rod 204. The drain passage 404 enables the degree of damping provided by the damping cavity 402 during VCR mode changes to be tuned. To elaborate, when the VCR mechanism 202 transitions from the higher compression ratio configuration to the lower compression ratio configuration, the volume of the damping cavity 402 decreases. During this type of modal transition, the drain passage 404 impedes fluid flow from the cavity and therefore controls the rate at which the modal transition unfolds and the amount of impact damping. The drain passage size and/or profile may be selected to control the effective flow area and balance the trade-off between VCR modal switching time and rod impact damping. For instance, the drain passage may be circular or rectangular in cross-section and exhibit a varying cross-sectional area along its length to provide desired flow dynamics in the VCR mechanism. Thus, in one use-case example, the drain passage may increase or decrease in cross-sectional area along its length to achieve a targeted VCR mode switching duration and rod impact damping characteristics.

The damping cavity 402 is positioned at an interface 406 between the first rod section 210 and the second rod section 212. The interface 406 includes two axially aligned surfaces 408. However, other interface profiles have been contemplated. The axially aligned surfaces form a portion of the boundary of the damping cavity 402. The damping cavity 402 may therefore have an annular shape, in one example. In such an example, the damping cavity may circumferentially extend around the rod. It will also be appreciated that the size of the damping cavity changes when the VCR mechanism 202 transitions to the higher compression ratio configuration, shown in FIG. 5, from the lower compression ratio configuration shown in FIGS. 3 and 4.

The drain passage 404 may be machined into the second rod section 212 of the rod 204, to allow a desired sizing of the passage to be achieved. A manufacturing method of measuring fluid leakage and then using an Electric Discharge Machining (EDM) process to achieve a variable diameter passage targeting the desired leak rate, may be used. However, alternate drain passage manufacturing techniques may be used, in other examples.

The first rod section 210 includes a first lip 410 and the second rod section 212 includes a second lip 412. The lips 410, 412 extend in a direction perpendicular to the centerline 414 of the adjustable length rod 204. However, other lip contours have been envisioned. The distance, between the first and second lips 410, 412 changes during a compression ratio modal transition. The damping cavity 402 serves to decrease the impact between the lips 410, 412 when the VCR mechanism 202 transitions to the lower compression ratio configuration illustrated in FIG. 5. The amount of impact damping provided by the damping cavity 402 may be tuned via the sizing of the drain passage 404 and the pressure of the fluid provided to the damping cavity 402, as previously discussed. The angle and more generally the path of the drain passage 404 may also be selected to enable the flow resistance of the passage to be adjusted. For instance, the drain passage 404 may be curved to increase the drain passage's flow resistance. In one use-case example, the drain passage 404 may have a diameter between 0.050 millimeters (mm) and 0.500 mm.

The drain passage 404 may include a valve, in one example, to enable finer tuning of the damping characteristics of the damping cavity. For instance, the valve may be designed to ramp up dampening near the end of the variable length rod's travel, to speed up switching speed while providing a desired level of impact dampening.

Turning to FIG. 5, the VCR mechanism 202 is illustrated in a lower compression ratio mode. As shown, in the lower compression ratio mode, the lips 410, 412 are adjacent to one another. As such, the size of the damping cavity is decreased (e.g., minimized) when the VCR mechanism 202 switches to the higher compression ratio mode. The decreased volume of the damping cavity 402 causes fluid evacuation therefrom and as previously discussed the speed of the volumetric reduction of the damping cavity may be dictated by the size and profile of the drain passage. In this way, hydraulic damping designed to reduce the impact between the first rod section 210 and the second rod section 212 can be achieved.

Additionally, as shown in FIG. 5, the first lock pin 300 is decoupled from the first lock pin recess 302 in the first locking device 216 and the second lock pin 304 is mated with the second lock pin recess 306. In this way, the relative position of the first rod section 210 and the second rod section 212 may be maintained in the higher compression mode. However, other locking pin arrangements for the lower compression ratio may be used, in other embodiments.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. Further in one example, components offset from one another may be referred to as such.

FIG. 6 shows a method 600 for operation of an engine system. The method 600 may be carried out by the engine systems described above with regard to FIGS. 1-5. However, in other examples, the method 600 may be implemented via other suitable engine systems. The method may be stored in non-transitory memory of a controller. Furthermore, the method may include instructions within a controller as well actions taken by the controller.

At 602, the method includes determining operating conditions in the engine system. The operating conditions may include engine speed, engine load, throttle position, pedal position, engine temperature, etc. Next at 604, the method determines if and which type of VCR modal is desired. The type modal transition may be a transition to a higher compression ratio mode from a lower compression ratio mode or vice-versa. The threshold values may be used to determine if conditions triggering a modal transition are satisfied. For instance, if an engine speed and/or engine load surpasses a corresponding threshold value it may be determined that a modal transition to the lower compression ratio mode is wanted. Conversely, if engine speed and/or engine load drops below a corresponding threshold, it may be determined that a modal transition to the higher compression ratio mode is desired. Therefore, the engine may be operated at the high compression ratio when in low speed and load operating points and may be operated at the low compression ratio when in high speed and load operating points.

If it is determined that a VCR modal transition is not desired (NO at 604), the method advances to 605 where the method includes maintaining the current engine operating strategy. For instance, the VCR mechanism may maintain its current operating mode.

However, if it is determined that a higher compression ratio modal switch is desired the method moves to 606. At 606, the method includes transitioning to a higher compression ratio mode. Transitioning to the higher compression ratio mode may include steps 608-612. At 608, the method includes operating the rod length adjustment assembly to increase a length of the adjustable length piston rod. To elaborate, the locking devices may be hydraulically actuated to increase the rod's length. For instance, in the first locking device, the first lock pin may be mated with the first lock pin recess and in the second locking device, the second lock pin may be decoupled from the second lock pin recess. In this way, the piston's TDC position is altered to increase the compression ratio of the engine. At 610, the method includes flowing pressurized fluid into the damping cavity and at 612, the method includes restricting a flow of fluid from the damping cavity. It will be appreciated that the drain passage in the rod length adjustment assembly functions to restrict the fluid flow out of the damping cavity, as previously discussed.

If it is determined that a lower compression ratio modal switch is desired, the method proceeds to 614. At 614, the method includes transitioning to the lower compression ratio mode. Transitioning to the lower compression ratio mode may include steps 616-620. At 616, the method includes operating the rod length adjustment assembly to decrease a length of the adjustable length piston rod. For instance, in the first locking device, the first lock pin may be decoupled from the first lock pin recess and in the second locking device, the second lock pin may be mated with the second lock pin recess. In this way, the piston's TDC position is altered to decrease the compression ratio of the engine. At 618, the method includes flowing pressurized fluid into the damping cavity and at 620, the method includes restricting a flow of fluid from the damping cavity via the drain passage. Thus, during the transition to the lower compression ratio mode, the drain passage allows the impact velocity of the first and second rod sections to be decreased. Consequently, NVH in the VCR mechanism can be reduced.

FIG. 7 shows a graphical embodiment 700 of a control technique for a VCR mechanism in an engine system. In each graph time is indicated on the abscissa. Plot 702 indicates the operational mode (a higher compression ratio mode and a lower compression ratio mode) of the VCR mechanism on the ordinate. Plot 704 indicates engine speed on the ordinate and an engine speed threshold triggering a VCR mode transition is indicated at 706.

As shown, at t1 the engine speed falls below the threshold value 706. Responsive to the engine speed dropping below the threshold value, the engine transitions to the higher compression ratio mode by hydraulically adjusting locking devices in the VCR mechanism. As previously discussed, the damping cavity along with the drain passage function to decrease the impact between the rod sections during the modal transition. In this way, NVH may be decreased during VCR modal transitions, increasing customer satisfaction and decreasing the likelihood of VCR mechanism degradation caused by the impacts between the rod sections.

The technical effect of the methods and systems described herein with a damping circuit in a VCR mechanism is to decrease NVH in the mechanism when it transitions between compression ratio modes.

The invention will be further described in the following paragraphs. In one aspect, an engine system is provided that includes a variable compression ratio (VCR) mechanism including: a rod length adjustment assembly configured to adjust a distance between a crankshaft interface and a piston interface; and a fluid control circuit including a damping cavity positioned between a first rod section and second rod section and configured to dampen a relative motion between the first and second rod section during a compression ratio adjustment to reduce noise, vibration, and/or harshness (NVH).

In another aspect, a method for operation of an engine system is provided that includes during a compression ratio adjustment in the engine system in which a distance between a crankshaft interface and a piston interface is adjusted via a rod length adjustment assembly, flowing a pressurized fluid into a fluid conduit and into a damping cavity; and restricting a flow of the pressurized fluid out of the damping cavity via a drain passage.

In another aspect, an engine system is provided that includes a variable compression ratio (VCR) mechanism coupled to a piston and comprising: a first rod section coupled to a crankshaft interface; a second rod section adjustably attached to the first rod section and coupled to a piston interface; and a rod length adjustment assembly coupled to the first and second rod sections and configured to adjust a distance between a crankshaft interface and a piston interface; and a fluid control circuit comprising: a supply passage routing a pressurized fluid to a damping cavity with a volume changing during a compression ratio adjustment, where the damping cavity is arranged between the first rod section and the second rod section; and a drain passage in fluidic communication with the damping cavity and configured to restrict fluid flow therethrough.

In yet another aspect, an engine system is provided that includes a variable compression ratio (VCR) mechanism coupled to a piston and comprising: a first rod section coupled to a crankshaft interface; a second rod section adjustably attached to the first rod section and coupled to a piston interface; and a rod length adjustment assembly coupled to the first and second rod sections and configured to adjust a distance between a crankshaft interface and a piston interface; a fluid control circuit comprising: a supply passage routing a pressurized fluid to a damping cavity with a volume changing during a compression ratio adjustment, where the damping cavity is arranged between the first rod section and the second rod section; and a drain passage in fluidic communication with the damping cavity and configured to restrict fluid flow therethrough.

In any of the aspects or combinations of the aspects, a volume of the damping cavity may change during the compression ratio adjustment.

In any of the aspects or combinations of the aspects, the first rod section may include a first lip and the second rod section may include a second lip and where, during the compression ratio adjustment, the relative position between the first lip and the second lip changes.

In any of the aspects or combinations of the aspects, the fluid control circuit may include a drain passage and where the drain passage may restrict fluid flow therethrough, during the compression ratio adjustment, to reduce an impact velocity between the first lip and the second lip.

In any of the aspects or combinations of the aspects, the VCR mechanism may be configured to operate in a higher compression ratio mode and a lower compression ratio mode.

In any of the aspects or combinations of the aspects, the engine system may further include a controller including: instructions stored in non-transitory memory that when executed cause the controller to: initiate the compression ratio adjustment responsive to a change in an engine speed and/or an engine load; where initiating the compression ratio adjustment includes selecting a first compression ratio mode or a second compression ratio mode; and where the first and the second compression ratio modes have inequivalent compression ratios.

In any of the aspects or combinations of the aspects, the engine system may further include a controller including: instructions stored in non-transitory memory that when executed cause the controller to: initiate the compression ratio adjustment responsive to a change in an engine speed and/or an engine load.

In any of the aspects or combinations of the aspects, the rod length adjustment assembly may include a locking device that comprises a hydraulically operated lock pin that is designed to engaged and disengage from a lock pin recess when transitioning between an engaged state and a disengaged state.

In any of the aspects or combinations of the aspects, the hydraulically operated lock pin may be in fluidic communication with a control passage where the fluid control circuit includes a supply passage in fluidic communication with the control passage and a damping cavity with a volume changing during a compression ratio adjustment and where the damping cavity is arranged between a first rod section and a second rod section.

In any of the aspects or combinations of the aspects, the damping cavity may have an annular shape.

In any of the aspects or combinations of the aspects, a size of the drain passage may be tuned to achieve a target amount of impact damping and a target amount of compression ratio adjustment speed.

In any of the aspects or combinations of the aspects, the compression ratio adjustment may include transitioning into a first compression ratio mode; or transitioning into a second compression ratio mode; where the first and the second compression ratio modes have inequivalent compression ratios.

In any of the aspects or combinations of the aspects, the compression ratio adjustment may include actively adjusting a pressure of the pressurized fluid responsive to a change in an engine operating condition.

In any of the aspects or combinations of the aspects, the compression ratio adjustment may include engaging or disengaging a locking mechanism included in the rod length adjustment assembly.

In any of the aspects or combinations of the aspects, the first rod section may include a first lip and the second rod section includes a second lip and where the during compression ratio adjustment the relative position between the first lip and the second lip changes.

In any of the aspects or combinations of the aspects, the compression ratio adjustment may include transitioning to a lower compression ratio configuration from a higher compression ratio configuration.

In any of the aspects or combinations of the aspects, the damping cavity may have an annular shape.

In any of the aspects or combinations of the aspects, the engine system may further include a controller including: instructions stored in non-transitory memory that when executed cause the controller to: initiate the compression ratio adjustment responsive to a change in an engine speed and/or an engine load; where initiating the compression ratio adjustment includes selecting a first compression ratio mode or a second compression ratio mode; and where the first and the second compression ratio modes have inequivalent compression ratios.

In another representation, an engine system is provided that includes a fluidic impact damping circuit in a VCR mechanism that includes a damper enclosure that receives fluid from a control passage and expels fluid via a drain, the damper enclosure is positioned between two rod pieces that impact one another during a VCR modal transition.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the terms "approximately" and "substantially" are construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine system, comprising:

a variable compression ratio (VCR) mechanism including:

a rod length adjustment assembly configured to adjust a distance between a crankshaft interface and a piston interface; and a fluid control circuit including a damping cavity positioned between a first rod section and second rod section and configured to dampen a relative motion between the first and second rod sections during a compression ratio adjustment to reduce noise, vibration, and/or harshness (NVH), wherein the damping cavity is parallel to a longitudinal axis of the connecting rod and drains from a first lip of the first rod section.

2. The engine system of claim 1, where a volume of the damping cavity changes during the compression ratio adjustment.

3. The engine system of claim 2, where the second rod section includes a second lip and where, during the compression ratio adjustment, the relative position between the first lip and the second lip changes.

4. The engine system of claim 3, where the fluid control circuit includes a drain passage and where the drain passage restricts fluid flow therethrough, during the compression ratio adjustment, to reduce an impact velocity between the first lip and the second lip.

5. The engine system of claim 1, where the VCR mechanism is configured to operate in a higher compression ratio mode and a lower compression ratio mode.

6. The engine system of claim 1, further comprising a controller including:

instructions stored in non-transitory memory that when executed cause the controller to:

initiate the compression ratio adjustment responsive to a change in an engine speed and/or an engine load;

where initiating the compression ratio adjustment includes selecting a first compression ratio mode or a second compression ratio mode; and where the first and the second compression ratio modes have inequivalent compression ratios.

7. The engine system of claim 1, further comprising a controller including:

instructions stored in non-transitory memory that when executed cause the controller to:

initiate the compression ratio adjustment responsive to a change in an engine speed and/or an engine load.

8. The engine system of claim 1, where the rod length adjustment assembly includes a locking device that comprises a hydraulically operated lock pin that is designed to engaged and disengage from a lock pin recess when transitioning between an engaged state and a disengaged state.

9. The engine system of claim 8, where the hydraulically operated lock pin is in fluidic communication with a control passage where the fluid control circuit includes a supply passage in fluidic communication with the control passage and the damping cavity with a volume changing during the compression ratio adjustment and where the damping cavity is arranged between the first rod section and the second rod section.

10. The engine system of claim 9, where the damping cavity has an annular shape.

11. A method for operation of an engine system, comprising:

during a compression ratio adjustment in the engine system in which a distance between a crankshaft interface and a piston interface is adjusted via a rod length adjustment assembly, flowing a pressurized fluid into a fluid conduit and into a damping cavity; and restricting a flow of the pressurized fluid out of the damping cavity via a drain passage parallel to a longitudinal axis of the connecting rod, and draining the pressurized fluid via the drain passage, wherein the drain passage opens in a first lip of a rod length adjustment assembly.

12. The method of claim 11, where a size of the drain passage is tuned to achieve a target amount of impact damping and a target amount of compression ratio adjustment speed.

13. The method of claim 11, where the compression ratio adjustment includes:

transitioning into a first compression ratio mode; or transitioning into a second compression ratio mode;

where the first and the second compression ratio modes have inequivalent compression ratios.

14. The method of claim 11, where the compression ratio adjustment includes:

actively adjusting a pressure of the pressurized fluid responsive to a change in an engine operating condition.

15. The method of claim 11, where the compression ratio adjustment includes engaging or disengaging a locking mechanism included in the rod length adjustment assembly.

16. An engine system, comprising:

a variable compression ratio (VCR) mechanism coupled to a piston and comprising:

a first rod section coupled to a crankshaft interface;

a second rod section adjustably attached to the first rod section and coupled to a piston interface; and a rod length adjustment assembly coupled to the first and second rod sections and configured to adjust a distance between the crankshaft interface and the piston interface; and a fluid control circuit comprising:

a supply passage routing a pressurized fluid to a damping cavity with a volume changing during a compression ratio adjustment, where the damping cavity is arranged between the first rod section and the second rod section; and a drain passage in fluidic communication with the damping cavity and configured to restrict fluid flow therethrough, wherein the damping cavity is parallel to a longitudinal axis of the connecting rod and drains from a first lip of the first rod section.

17. The engine system of claim 16, where the first rod section includes a first lip and the second rod section includes a second lip and where during the compression ratio adjustment the relative position between the first lip and the second lip changes.

18. The engine system of claim 16, where the compression ratio adjustment includes transitioning to a lower compression ratio configuration from a higher compression ratio configuration.

19. The engine system of claim 18, where the damping cavity has an annular shape.

20. The engine system of claim 16, further comprising a controller including:

instructions stored in non-transitory memory that when executed cause the controller to:

initiate the compression ratio adjustment responsive to a change in an engine speed and/or an engine load;

where initiating the compression ratio adjustment includes selecting a first compression ratio mode or a second compression ratio mode; and where the first and the second compression ratio modes have inequivalent compression ratios.

* * * * *